United States Patent [19]

Morano et al.

[11] Patent Number: 4,605,102

[45] Date of Patent: Aug. 12, 1986

[54] TRANSPORTATION SYSTEM HAVING MULTIPLE DIRECTION CARGO CARRIER DOOR OPENER

[75] Inventors: Robert E. Morano, Ringwood; Victor J. Vogel, Oak Ridge; Peter Pawchak, Randolph, all of N.J.

[73] Assignee: American Standard Inc., New York, N.Y.

[21] Appl. No.: 622,704

[22] Filed: Jun. 20, 1984

[51] Int. Cl.[4] ..... B61D 19/02; B61B 1/00

[52] U.S. Cl. ..... 186/37; 186/28; 104/29; 105/29 R; 191/23 R

[58] Field of Search ..... 49/262, 31, 326; 104/27, 28, 29; 105/29 R, 341; 191/23 R; 186/26–28, 33–35, 37, 52, 53, 58; 187/31, 51, 58

[56] References Cited

U.S. PATENT DOCUMENTS

| | | | |
|---|---|---|---|
| 2,265,478 | 12/1941 | Gibson | 186/28 X |
| 2,896,748 | 7/1959 | McClintock | 186/37 |
| 3,636,883 | 1/1972 | Wesener | 104/50 |
| 4,411,336 | 10/1983 | Anders | 186/37 |
| 4,546,857 | 10/1985 | Hamada et al. | 186/37 |

FOREIGN PATENT DOCUMENTS

| | | | |
|---|---|---|---|
| 2645352 | 4/1978 | Fed. Rep. of Germany | 104/28 |
| 3132296 | 3/1983 | Fed. Rep. of Germany | 104/28 |
| 53-314 | 4/1977 | Japan | 105/341 |

OTHER PUBLICATIONS

Mosler Commercial Express Brochure (ASD 8856–5-M–Rev. 02/82).

Commercial Express Remote Transaction System Brochure (ASD–9083–3–Rev 06/81).

*Primary Examiner*—Robert B. Reeves

*Assistant Examiner*—David F. Hubbuch

*Attorney, Agent, or Firm*—Wood, Herron & Evans

[57] ABSTRACT

A transportation system in which cars having cargo containers are driven along tracks. Access to a car's cargo container is provided via a door on the car which is moved by a door drive system carried on the car. In the exemplary case of a remote bank teller transportation system, a car moves between two terminals in which the car and the car door are orientated vertically "right side up" in one terminal and "upside down" in the other terminal. The door drive system serves to move the door downwardly for both orientations of the car.

20 Claims, 9 Drawing Figures

TRANSPORTATION SYSTEM HAVING MULTIPLE DIRECTION CARGO CARRIER DOOR OPENER

DESCRIPTION OF THE INVENTION

This invention relates generally to a transportation system in which cars moving on tracks transport relatively small items of cargo from place to place. The invention is disclosed particularly in relation to a remote bank teller terminal system in which a car moving on a track conveys currency, checks, and the like between a teller terminal in the bank and a customer terminal outside the bank.

In transportation systems of the general type which shall be described herein, self-propelled electrically driven transport cars move from station to station along a track containing power rails. The power rails supply electrical power to drive motors on the cars which drive the cars along the track. Often the set of tracks in the transportation system includes horizontal and vertical track sections, and wheels on each car move within guide portions of the track to maintain the car on the track. In the presently illustrated system, each car carries a driven gear which engages a gear rack along the track to move the car along the track.

Such transportation systems find a number of industrial applications such as the transportation of letters or files within an office building or the transportation of medicines within a hospital. Another industrial application, which shall be described herein with regard to a particular embodiment of the invention, is the transport of currency, checks, deposit slips and the like between a teller terminal in a bank and a customer terminal outside the bank. The customer terminal is typically provided along a drive-thru lane so that customers of the bank may conduct banking activities from their automobiles. In such a remote teller terminal system, a car moves on a track between the bank teller terminal and the remote customer terminal within a tunnel or an overhead enclosure. The car generally moves in a horizontal direction, traversing a horizontal section of track, through the tunnel or enclosure, moving into each terminal on vertical sections of track.

The car has a drive portion which includes the car's wheels, the driven gear, and a drive motor. The car is electrically coupled to a pair of power rails in the track which supply electrical power to the car drive motor via brushes mounted on the drive portion of the car. The brushes are maintained in electrical contact with the two power rails as the car moves along the track.

The car also has a container portion which includes a container for the currency and the like which is to be transported. One wall of the container is defined by a movable door which is moved to an open position to permit access to the container. In the case of a remote bank teller terminal system including an underground tunnel, for example, the car travels "upside down", on a horizontal section of track, through the tunnel, with the drive portion of the car adjacent the track and the container portion of the car below the drive portion. In this orientation of the car, the car door for providing access to the container is at the bottom of the car.

At each of the terminals, the teller terminal and the customer terminal, the track terminates in a vertical section of track, and the car is driven upwardly along the vertical track section into the terminal. When in the terminal, the door is oriented vertically, with the container portion of the car facing the teller or the customer, with access to the container being provided when the door is moved to an open position.

Each terminal is configured to provide a housing around the vertical section of track, and when a car is present, around the car. Each terminal includes a terminal door, which is located generally parallel to and in front of the car door when the car is in the terminal. When the car is in the terminal, the terminal door serves as an outer door and the car door serves as an inner door to permit access to the car container when both of these doors are open.

The outer door is opened by a drive arrangement in the terminal which moves the outer door downwardly into the terminal housing. In the past, the inner door, the door on the car, has been mechanically coupled to the driven outer door so that the inner door opens with the outer door, permitting access to the car container. In order for this mechanically coupled door drive to operate successfully, the car must be oriented properly within the terminal. In practical systems this proper alignment cannot always be assured. A further difficulty with such a mechanically interconnected door drive is the danger of movement of the car away from the terminal before the doors are fully closed and the mechanical coupling between the doors disconnected. In this case there can be damage to the car or to the terminal door or to both.

It is the general aim of the present invention to provide a transportation system of the foregoing type in which the car door is operable independently of external mechanical connections thereto.

This objective has been accomplished in the presently disclosed transportation system by providing a car door drive system which is mounted on the car itself. In the disclosed remote teller transportation system this car door drive includes a drive motor mounted on the car which is powered from the track power rails. The door drive motor is controlled by a control circuit, which is responsive to the stopping of the car in a terminal, and the movement of the terminal door, to control the operation of the car door drive motor to properly open and close the car door in coordination with the terminal door.

In accordance with a further aspect of the invention, as shown with regard to the illustrated remote bank teller terminal transportation system, the direction of movement of the car door is selected to be a downward direction when the car is stopped in either of the terminals, although this requires movement of the door in opposite directions relative to the car depending upon which terminal the car is in.

It is contemplated that the provision of a car door drive on the car in transportation systems of the foregoing type may find application in other environments than the remote bank teller terminal area described herein. For example, such transportation systems used in office buildings, industrial plants or hospitals may advantageously employ cargo-carrying cars having doors which may be opened without the application of external mechanical force such as through mechanical coupling or by hand.

Other objects and advantages of the invention, and the manner of their implementation will become apparent upon reading the following detailed description and upon reference to the drawings, in which.

Figure 1:
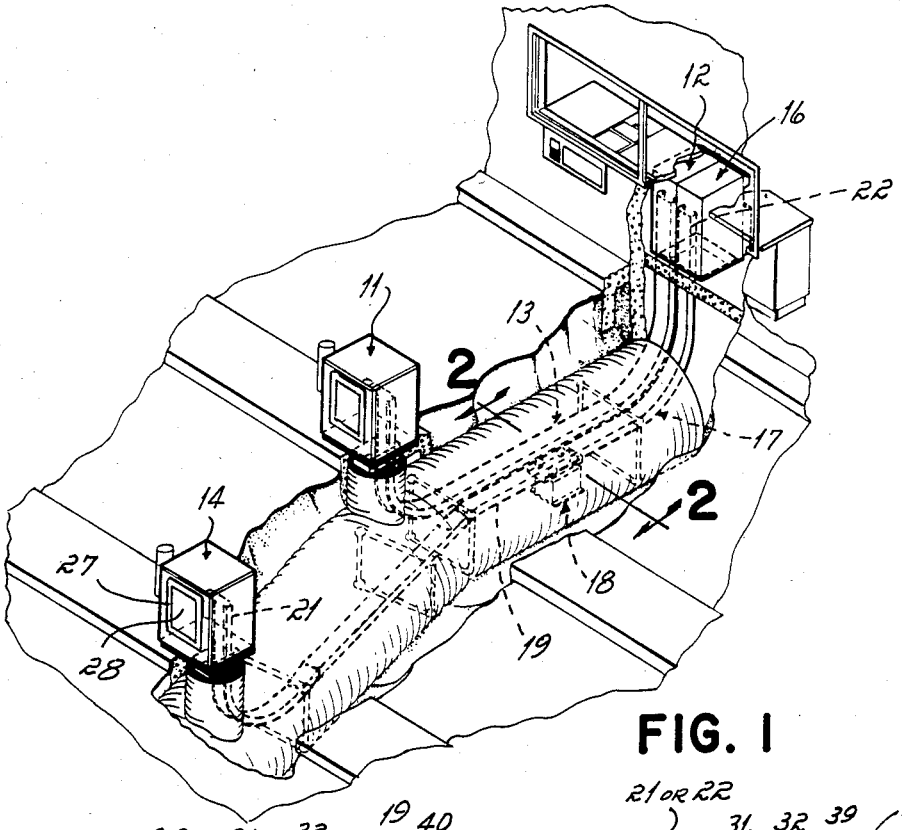
FIG. 1 is a diagrammatic view of a remote bank teller transportation system.
Figure 2A:
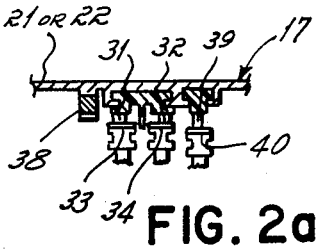
FIG. 2 is an end view of a car in the system of FIG. 1 showing the interconnection between the drive portion of the car and the track, as seen on line 2—2 of FIG. 1.
Figure 2:
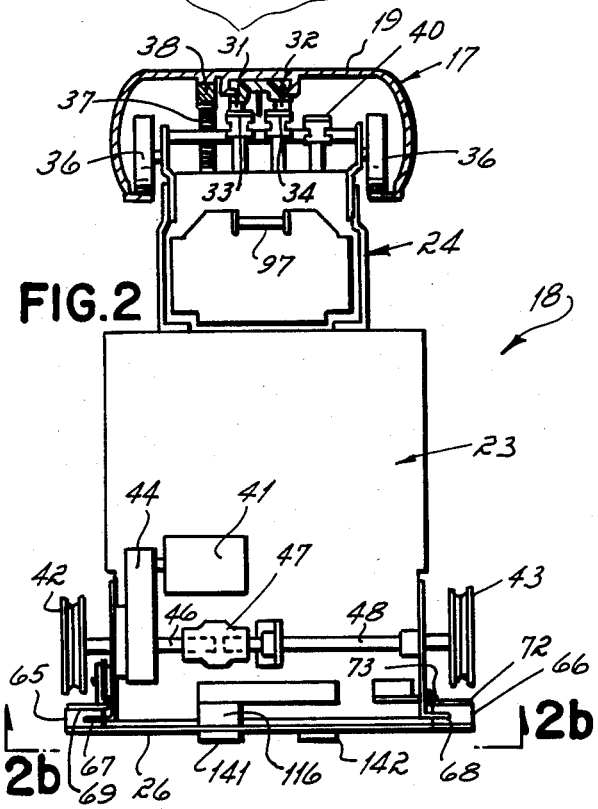
Figure 2B:
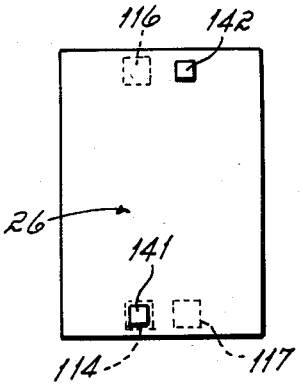
Figure 3:
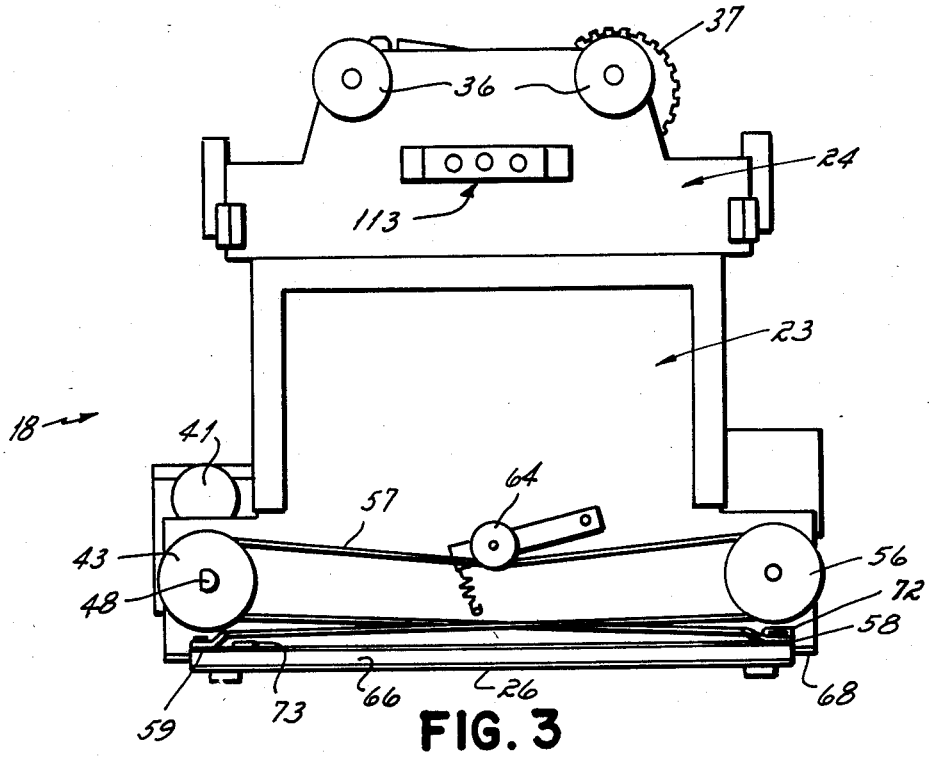
Figure 4:
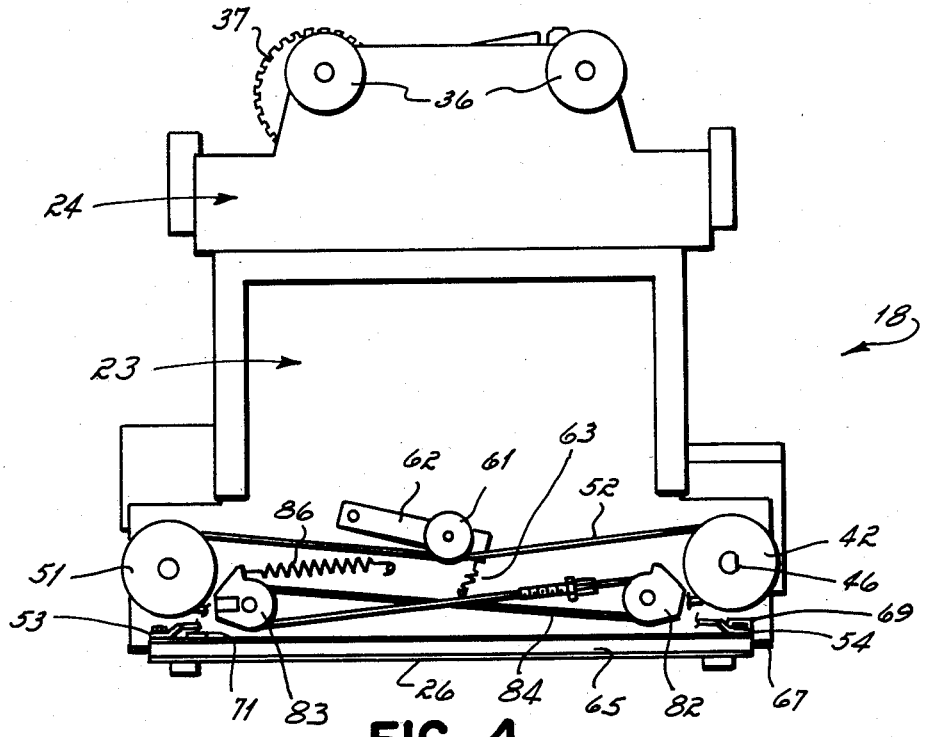
Figure 5:
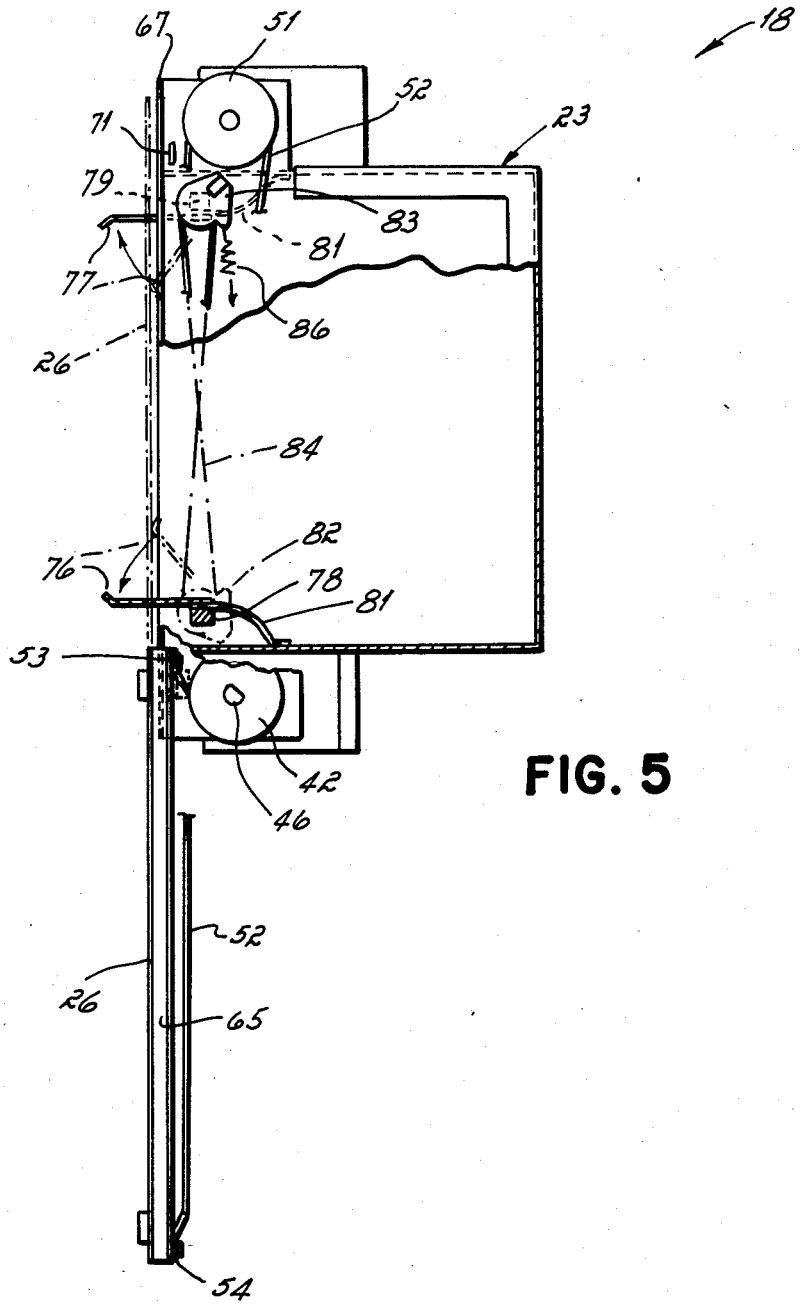
Figure 6:
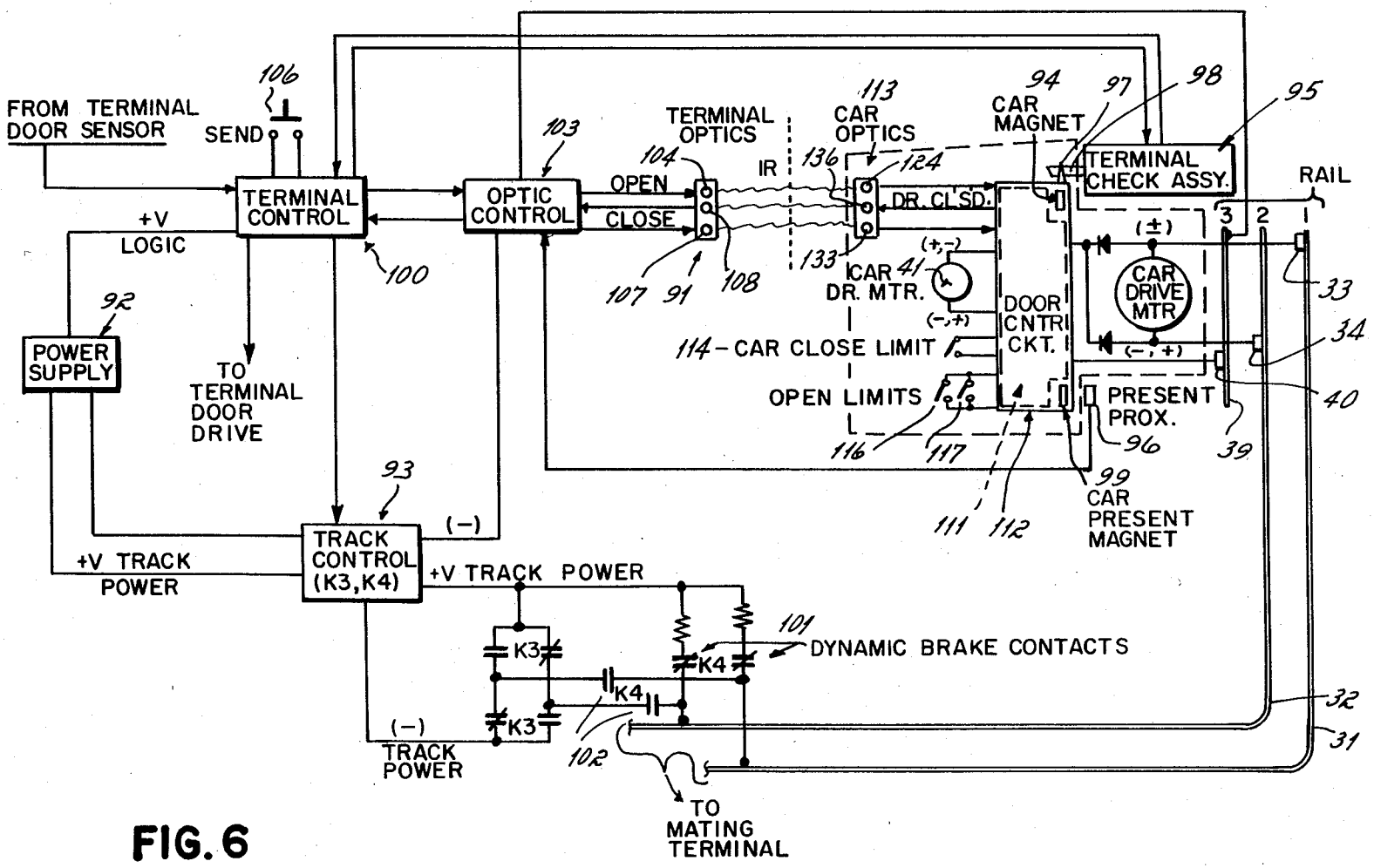
Figure 7:
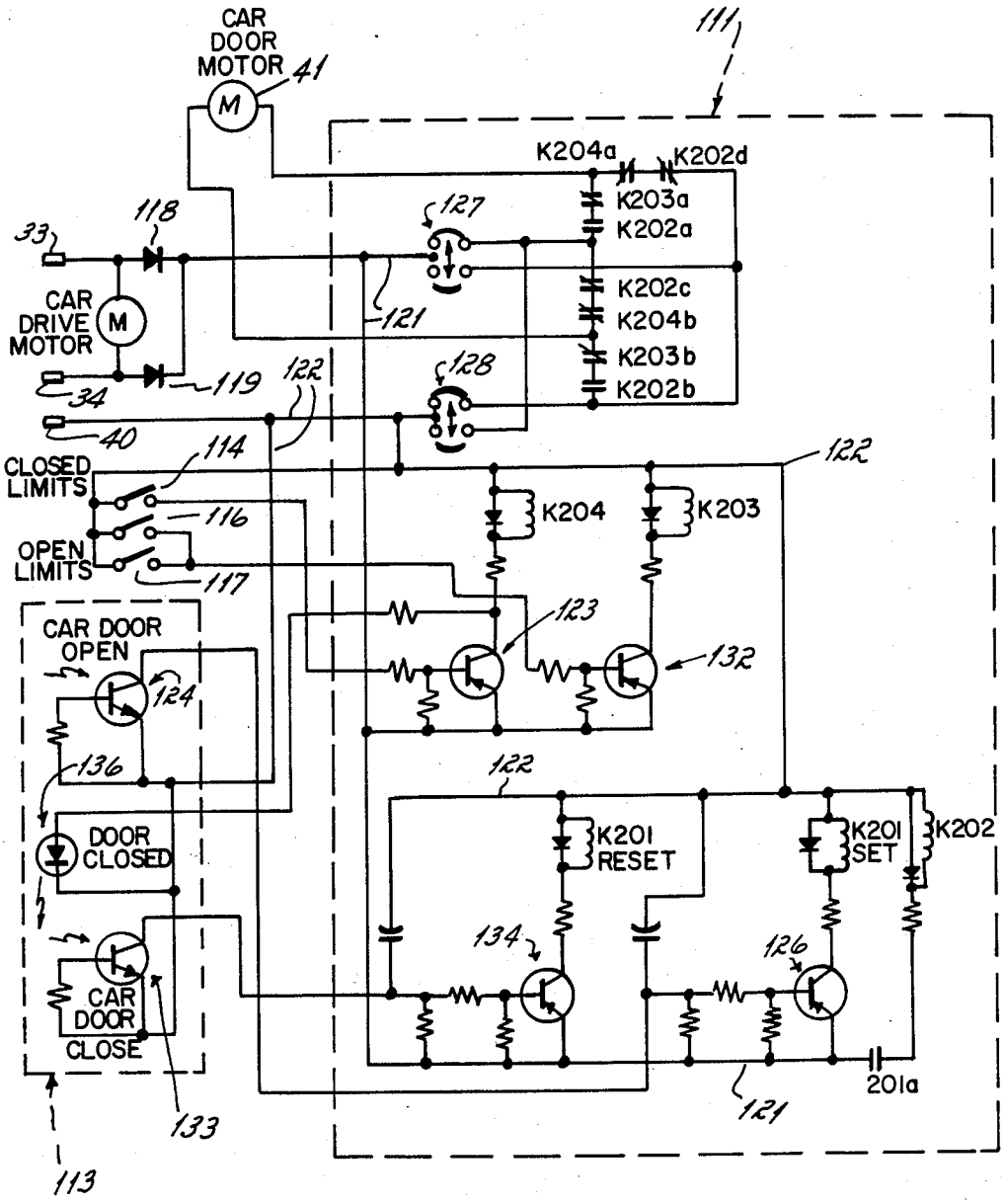

FIG. 2*a* is a sectional view of a portion of the track in a terminal, showing the third rail;

FIG. 2*b* is a plan view of a car door as seen on line 2*b*—2*b* of FIG. 2;

FIG. 3 is a side view of the car of FIG. 2;

FIG. 4 is an opposite side view of the car of FIG. 2;

FIG. 5 is a side view similar to that of FIG. 4, having areas broken away for clarity and showing the car door in a container-open position;

FIG. 6 is a diagrammatic illustration of a terminal control for the system of FIG. 1; and FIG. 7 is a schematic diagram of the car door drive control circuitry for the car of FIG. 2.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

With reference now to FIG. 1, a remote bank teller transportation system includes a first customer terminal 11 linked to a first teller terminal 12 by a track 13. The track 13 extends through a tunnel between the two terminals. A second customer terminal 14 is linked to a second teller terminal 16 by a track 17 contained within the underground tunnel. While the number of tracks and terminals in a particular system may vary, the present invention shall be described in terms of the single pair of terminals 14, 16 and the interconnecting track 17.

A car 18 traverses the track 17 to carry currency, bank notes and the like between the customer terminal 14 and the teller terminal 16. The track 17 which is traversed by the car 18 includes a generally horizontal section 19, and vertical sections 21, 22 at the terminals 14, 16, respectively.

With additional reference now to FIG. 2, the car 18 includes a portion 23 defining a cargo container and a car drive portion 24, which makes electrical and mechanical contact with the track 17 to move the car between the terminals. As the car 18 moves along the horizontal track section 19, the car is "upside down"; that is, the container portion 23 is suspended beneath the drive portion 24. In this orientation of the car, a car container door 26 is at the bottom of the container 23.

When the car 18 enters the customer terminal 14 and comes to rest, the car door 26 is oriented vertically behind an opening 27 in the customer terminal 14. The access opening 27 is closed by a movable terminal door 28. The terminal door 28 serves as an "outer" door and the car door 26 serves as an "inner" door for permitting or restricting access to the car container 23.

When the car 18 enters and stops within the teller terminal 16, the car door 26 is also oriented vertically, but the orientation of the car and the door is reversed, or rotated through 180°, from that of the car and door within the customer terminal 14.

In operation, assuming that the car 18 is initially stored in the customer terminal 14 with the doors 26, 28 closed, a customer drives up to the customer terminal and depresses a switch to provide an audible indication to a teller of the presence of a customer at the customer terminal. Depression of this switch also provides a door-open signal for both the inner door and the outer door. Preferably, due to door drive motor speed differences, the outer door opens first, before the car door completes its movement to an open position. Both the inner door and the outer door move downwardly.

The teller then makes voice contact with the customer through an audio system, and the customer places the transaction items to be transported in the car and depresses a "send" switch. This initiates a door-close and car-return cycle. First, the outer door closes, and when it reaches a fully closed position, the car receives a command to close the car door. When the car door reaches a closed position, the car is released by a mechanical check mechanism, and power is supplied to drive the car to the teller terminal 16.

When the car reaches the teller terminal 16, it is stopped within the terminal and mechanically held therein. After a brief delay, to insure that the car is seated on the mechanical stop, a door-open cycle is initiated at the teller terminal. As in the case of the door-open cycle at the customer terminal 14, both doors open generally simultaneously. After the doors are completely open, the teller completes the banking transaction, places the appropriate transaction items in the car container 23, and depresses a "send" switch. As in the case of the customer terminal 14, the outer door at the teller terminal first closes, and then the inner door closes. After the inner car door is closed, the mechanical stop releases the car and power is applied to the car to drive the car back to the customer terminal 14.

After the car reaches the customer terminal 14, and is secured therein, and after a brief delay to insure that the car is properly seated on the mechanical stop, a door-open cycle is initiated. When the doors are fully open, the customer removes the remainder of the transaction items and drives away. Preferably, a "door close" switch is provided for the teller in order to initiate a door-close cycle while the car remains at the customer terminal 14.

In order to drive the car 18 along the track 17, electrical power from a pair of power rails 31, 32 in the track is electrically coupled by brushes 33, 34 on the car to a drive motor (not shown in FIG. 2) in the drive portion 24 of the car. The car drive motor in turn drives a gear 37, which engages a gear rack 38 on the track 17. The car is supported by wheels 36 engaged with track 17. Such car drive arrangements are described, for example, in U.S. Pat. Nos. 3,340,821, 3,502,038, and 3,636,883, to Wesener.

As shown in FIG. 2*a*, within each of the terminals, such as the customer terminal 14, the track includes a third rail 39 which is engaged by a third rail brush 40 carried by the car. Therefore, in the customer unit 14, on the vertical section of track 21, electrical power is coupled to the car via this third rail 39, as shall be described in more detail hereinafter.

In accordance with one aspect of the invention, when the car 18 is driven into a terminal such as the customer terminal 14, and the door 26 is moved to a container-open position or a container-closed position in coordination with the movement of the terminal door 28, the car door drive is provided by the car without any mechanical coupling between the terminal door and the car door. With further reference to FIGS. 2–5, this independent door drive is accomplished by a motor 41 mounted on the car 18. The motor 41 drives a pair of door drive pulleys 42, 43 on opposite sides of the door via a gear train 44. The gear train 44 is coupled to a shaft 46 upon which the pulley 42 is mounted. The drive shaft 46 is also coupled, via a flexible coupling 47, to a shaft 48 upon which the door drive pulley 43 is mounted, so that the pulleys 42, 43 are driven in unison. The flexible coupling 47 obviates precise alignment of a single shaft for the pulleys 42, 43.

The door drive pulleys 42, 43 are mounted on their respective drive shafts on opposite sides of the car 18. To apply a driving force to one side of the door 26, the drive pulley 42 and an idler pulley 51 carry a belt 52 which is secured at a first end 53 to one end of the door 26 and at a second end 54 to the opposite end of the door. On the other side of the car, the drive pulley 43 and an idler pulley 56 carry a belt 57 which is secured at a first end 58 to the same end of the door as the end 53 of the belt 52. The other end 59 of the belt 57 is attached to the opposite end of the door, the end to which the end 54 of the belt 52 is attached. The belt 52 is tensioned by a tensioning roller 61 rotatably mounted on a pivotable bracket 62. A spring 63 attached at a first end to the car 18 and at its other end to the bracket 62 urges the roller 61 into engagement with the belt 52, tensioning the belt. In a similar fashion a tensioning roller 64 is urged into contact with the belt 57, tensioning the belt.

The door drive motor 41 is a reversible motor, and consequently may drive the pulley shafts 46, 48 in either direction. The direction of rotation of the shafts 46, 48, and the pulleys 42, 43 thereon, determines the direction of movement of the door 26. Clockwise rotation of the pulleys 42, 43 (as viewed in FIG. 3) moves the door 26 from the container-closed position shown in FIG. 3 to a container-open position in which the door is moved to the left.

In FIG. 5, the car 18 is shown in its orientation within the customer terminal 14. The car is moved from the FIG. 4 orientation in which the car is horizontal and the door 26 is in the container-closed position, to the attitude in FIG. 5; and the door 26 is moved downwardly into a container-open position. In moving the door 26 to its position in FIG. 5, the door drive pulley 42 is rotated in a counterclockwise direction drawing the end 53 of the belt 52 downwardly, effecting movement of the door. Simultaneously, the drive pulley 43 on the opposite side of the car 18 draws the end 58 of the belt 57 downwardly so that the motive force for the door is applied from both sides of the car.

In order to guide the door 26 as it is moved between container-open and container-closed positions, the door 26 is attached at each side to guides 65, 66, which move with the door. These guides 65, 66 in turn receive flanges 67, 68 fixed to the car to provide tracks for the door and the guide strips on either side of the car.

When the car is in the customer terminal 14, the door 26 is moved downwardly to a container-open position so that the door is received within the bottom portion of the terminal 14. When the car is in the teller terminal 16, it has an orientation which is inverted from that of FIG. 5, but in this orientation, the door must also be driven downwardly to be received within the lower portion of the terminal 16. As shall be described in more detail hereinafter, a door drive control circuit on the car determines the orientation of the car so that the door is always driven to the proper container-open position. When the car 18 is in the teller terminal 16, the door 26 is driven in the direction of the idler pulleys 51, 56, which is a downward direction for the oreintation of the car in the teller terminal 16.

The door drive motor 41 is controlled to stop the door in a proper door-open position. In the event of a failure of the door drive control, mechanical stops are provided along the tracks 67, 68 to prevent driving the door off of the tracks. For the track 67, a flanged stop member 69 is carried on the guide strip 65 attached to the door, and this stop member is aligned to engage a stop 71 along the track 67 if the door is driven beyond the proper container-open position. For movement of the door in the opposite direction, a corresponding stop member 72 and stop 73 are provided for the track 68.

When the car 18 is in a terminal, and the door 26 moved to a container-open position, there is some spacing between the lower edge of the terminal opening (such as the opening 27 in the customer terminal 14) and the front face of the car. In order to prevent items which are carried in the car container from falling into this space between the car and the terminal, a money scoop mechanism is provided on the car. Since the car may be oriented in either vertical direction, the money scoop mechanism comprises protective flaps covering the opening between the car and the terminal at both the top and the bottom of the car container opening. Each of these flaps is urged outwardly (as best seen in FIG. 5) when the door 26 is moved to a container-open position. Each of these flaps 76, 77 is secured along a face of a square shaft 78, 79 and move via rotation of the shafts. A continuous web covering the shaft for each flap is provided in the interior of the car by a flexible seal strip such as 81 secured along a first edge to the shaft 78 and along a second edge to the interior of the car container.

When the door 26 is in the container-closed position, the flaps 76, 77 are urged against the door and retained by the door inside the container. When the door 26 is moved to a container-open position, the flaps 76, 77 move in unison to swing outwardly to the position shown in FIG. 5. When the door 26 is subsequently closed, the door engages one of the flaps 76, 77 and rotates the engaged flap into the interior of the car. The other flap moves in unison with the engaged flap into the car interior.

In order to effect the movement of the flaps 76, 77 in unison, each of the shafts 78, 79 is secured to a money scoop drive pulley 82, 83, respectively. A belt 84 is carried in criss-cross fashion on the pulleys 82, 83 and secured to each of the pulleys. In this way movement of the shaft 78 and pulley 82 in a clockwise direction, for example, results in the movement of the shaft 79 and pulley 83 in a counterclockwise direction. In this way the flaps 76, 77, mounted on the shafts 78, 79, are rotated in unison. Therefore, engagement of one of the flaps by the door 26 to move the flap results in corresponding movement of the other flap. In order to urge the flaps into the open position illustrated in FIG. 5, a spring 86, secured at one end to the car and at its other end to the pulley 83, applies a tension force to the pulley urging it to move in a clockwise direction (as viewed in FIG. 5) urging the flap 77 outwardly. Due to the coupling between the pulleys 82, 83 via the belt 84, the spring tension force concurrently urges the flap 76 outwardly.

Due to the common movement of the flaps 76, 77, as the door 26 is moved from the container-closed position to a container-open position, movement of the door beyond both of the flaps is required before the money scoop flaps will move to the open position (FIG. 5). Similarly, when the door 26 moves from a container-open position to the container-closed position, the door's engagement with one of the flaps, urging the flap inwardly, serves to move the other flap inwardly also due to the coupling by the belt 84 between the pulleys 82, 83.

As is customary in systems of this general type, means are provided at each terminal to stop the car in the terminal. In order to do this, the presence of the car at the terminal must be sensed, such as by a mechanical or a magnetic sensor. In the present system, communication must also be established between the car and the terminal to effect proper opening and closing of the car door by the car door drive on the car.

To illustrate the operation of the transportation system, with respect to an illustrative terminal and communication between the terminal and the car, a system control arrangement is shown diagrammatically in FIG. 6. In the illustrated control arrangement, car stopping and braking are accomplished mechanically and magnetically. Communication between the terminal and the car door control is performed optically using infrared light-emitting diodes and photosensors.

With reference now to FIG. 6, the car control system for the car 18 communicates with the car via the power rails 31, 32 and 39 and an optical communication array 91. The car control and the car (in electrical diagram form) are shown with the car 18 in the customer terminal 14. The configuration of the electrical and optical connections in the teller terminal 16 is substantially the same as that for the illustrated customer terminal.

The car 18 receives motor drive power for the car drive motor through the rails 31, 32 and the brushes 33, 34 on the car. Polarized rail track power is supplied from a power supply 92 through a track control circuit 93 which operates track control relays K3 and K4. The relay contacts K3 determine the polarity of the power applied to the rails 31, 32, and hence the direction of rotation of the car drive motor 41 and the direction of travel of the car.

When the car 18 arrives at the customer terminal 14 a leading magnet 94 is sensed by a car present proximity switch 96, which conditions a terminal control circuit 100 (via an optic control circuit 103) to permit the track control circuit 93 to subsequently inhibit the relay K4 circuit. After the car passes into the terminal, a terminal check assembly 95 mechanically engages a coupling 97 on the car with an arm 98. A coupling 97 (FIG. 2) is provided at each end of the drive portion 24 of the car 18. When the coupling 97 and the arm 98 are engaged, the terminal check assembly 95 provides a signal to the terminal control circuit 100, which in turn deactivates the track control relay coil K4 in the track control 93 to dynamically brake the car. This is accomplished by closing the relay K4 contacts 101 and opening the relay K4 contacts 102. When the contacts 101 are closed, the power rails 31, 32 are held at a common voltage equal to the track power supply +V. This, in turn, deactivates the car drive motor.

Once the car settles on the check assembly, a trailing magnet 99 on the car actuates the car present proximity switch 96. After a short delay, the closure of the switch 96 actuates a car present subcircuit in the optic control circuit 103. This initiates a door open cycle by the actuation of an infrared-emitting diode 104 in the terminal optics 91. At the same time as the LED 104 is activated, the optic control circuit 103 signals the terminal control circuit 100 to open the terminal door. Due to differences in the speed of the two door drives, the terminal door opens slightly before the car door fully opens. After the doors open, the requisite banking items may be placed in the car container and the car dispatched to the teller terminal.

In order to dispatch the car 18 from the customer terminal, a send switch 106 is activated, and the terminal control 100 activates the terminal door drive to close the terminal door. When the terminal door is fully closed, as communicated to the terminal control 100 from a terminal door sensor, the terminal control signals the optic control circuit 103 to activate an infrared-emitting diode 107. In response to this infrared signal, the car door is closed. When the car door is fully closed, a door-closed infrared signal is received by a photo sensor 108 in the terminal optic assembly 91, indicating that the car door is closed and the car is ready for departure from the terminal.

The optic control circuit 103 signals the "car door closed" information to the terminal control circuit 100, which in turn activates the terminal check assembly 95 to release the car. The terminal control circuit 100 also activates the relay K4 in the track control 93 to return power to the power rails 31, 32. The terminal control circuit 100 also activates or deactivates the relay K3 as necessary to reverse the polarity of voltage on the rails 31, 32 from that existing when the car was driven into the customer terminal 14, in order to drive the car out of the terminal toward the teller terminal 16.

To properly open and close the car door in the terminal, a car door control circuit 111 carried on the chassis (indicated generally 112) of the car 18 communicates with the terminal optics 91 through a set of car optics 113. The door control circuit 111 is also coupled to the door drive motor 41, to a door-closed limit switch 114, and to a pair of door-open limit switches 116, 117. The door control circuit 11 is also electrically coupled to the rails 31, 32 and 39 of the track.

Considering the operation of the car door control circuit 111 in more detail, and with reference to FIG. 7, the track power rails (not shown in FIG. 7) are coupled through the brushes 33, 34 and a pair of diodes 118, 119 to a positive supply bus 121 in the control circuit. The positive supply voltage +V is coupled from the positive rail (or when the car is in a terminal from both rails) to the bus 121.

A second bus 122 is maintained at a circuit common, or low, potential relative to the bus 121. This is accomplished by coupling the bus 122 to the third rail brush 40, which contacts the third rail 39 (which is at circuit common) when the car is in one of the terminals. When the car is not in a terminal, the bus 122 is "floating", or disconnected from the power circuit.

When the car 18 enters a terminal, such as the customer terminal 14, the brush 40 contacts the third rail 39 at the common potential, establishing the car bus 122 at the circuit common. The bus 121 is maintained at +V whenever the track rails 31,32 are energized. When the car enters the terminal, the car door is closed and the door-closed limit switch 114 is closed.

This closed limit switch 114 couples the common potential on the bus 122 to the base of a transistor 123, which is coupled in series with a relay coil K204 between the buses 121 and 122. The common potential coupled to the base of the transistor 123 turns on the transistor and energizes the relay K204. This opens the normally closed relay contacts K204*a* and K204*b*. With these contacts open, the car door motor 41 is deenergized.

After the car 18 is secured within the terminal, the "open door" diode 104 in the terminal optics 91 is energized to couple infrared radiation to a photosensor 124 in the car optics 113. This activates the photosensor and couples the common bus 122 to the base of a transistor 126, turning on the transistor. The transistor 126 is coupled in series with the set coil of a relay K201 between the buses 121 and 122. Turning on the transistor 126 activates the set coil for the relay K201, setting the relay.

Setting the relay K201 closes the relay contacts K201*a* in series with a relay K202. The relay coil K201 remains set, and the relay K202 activated, until the relay K201 is reset (which occurs when the car door is to be closed).

When the relay K202 is activated, the relay contacts K202*a* and K202*b* close, and the relay contacts K202*c* and K202*d* open. Closing the contacts K202*a* and K202*b* couples the door drive motor 41 across the buses 121 and 122, and the motor drives the car door to a container-open position.

The circuit path for the car door motor 41 is from the bus 121, through a mercury switch 127, the contacts K202*a*, normally closed contacts K203*a*, the door motor 41, normally closed contacts K203*b*, the closed contacts K202*b*, and a mercury switch 128, to the bus 122.

When the car is in the teller terminal rather than the customer terminal, the orientation of the car is inverted, and the mercury switches 127, 128 reverse the polarity of the voltage applied to the car door motor 41. In this way, the door is, as earlier described, always driven downwardly regardless of the orientation of the car.

As the door begins to open, the closed limit switch 114 opens, deactivating the relay K204, returning the contacts K204*a* and K204*b* to a closed condition. However, since at this time the relay K202 is activated, the contacts K202*c* and K202*d* in series with the contacts K204*b* and K204*a*, respectively, are open so that closing the contacts K204*a* and K204*b* has no effect on the operation of the door motor.

When the car door is open, one of the door open limit switches 116, 117 closes. When one of the door open limit switches is closed, a transistor 132 is turned on. The transistor 132 is coupled in series with a relay K203 between the buses 121 and 122 so that turning on the transistor 132 activates the relay K203. When the relay K203 is activated, the relay contacts K203*a* and K203*b* open, deenergizing the car door motor and stopping the door. At this time the relay K203 is energized since the transistor 132 is turned on, and the relay K202 is energized since the relay contacts K201*a* are held closed with the relay K201 in a set condition.

The car door remains in the container-open position until a car door close signal is produced by the diode 107 in the terminal optics 91. The infrared emission from the diode 107 is received by a photo sensor 133 in the car optics 113. The energized photo sensor 133 couples the circuit common on the bus 122 to the base of a transistor 134, turning on the transistor. The transistor 134 is coupled in series with the reset coil of the relay K201 between the buses 121 and 122. Turning on the transistor 134 activates the relay K201 reset coil, resetting the relay and opening the relay contacts K201*a*. When the contacts K201*a* open, the relay K202 is deenergized. Deenergizing the relay K202 opens the contacts K202*a* and K202*b*. Deactivation of the relay K202 also closes the contacts K202*c* and K202*d*. Since the relay K204 (activated by the door-closed limit switch 114) is not presently energized, the normally-closed contacts K204*a* and K204*b* (in series with the now-closed contacts K202*d* and K202*c*) complete a circuit path coupling the car door motor 41 across the buses 121, 122, in opposite polarity from that in which the door was opened.

The circuit path is from the bus 121, through the mercury switch 127, the contacts K202*c*, the contacts K204*b*, the motor 41, the contacts 204*a*, the contacts 202*d*, and the mercury switch 128 to the bus 122. As the door moves toward the closed position, the door-open limit switches 116, 117 are now both open, and the transistor 132 and relay K203 are deenergized. Since the contacts K202*a* and K202*b*, in series with the contacts K203*a* and K203*b*, respectively, are opened, the deenergization of the relay K203 has no effect on the door operation.

When the door reaches its closed position, the door-closed limit switch 114 closes, turning on the transistor 123 and activating the relay K204. This in turn opens the relay contacts K204*a* and K204*b*, deenergizing the car door motor 41. At the same time that the relay K204 is energized, turning on the transistor 123 also couples the potential from the bus 121 through the transistor 123 to a "door-closed" diode 136 in the car optics 113. The diode 136 is energized to emit infrared radiation, which is received by the photosensor 108 in the terminal optics 91, so that the optic control circuit 103 recognizes that the car door is closed. The terminal control circuitry may now release the car to send the car to the teller terminal. When the car leaves the terminal, and the brush 40 loses contact with the third rail 39, the door control circuit 11 is deenergized, although the relay K201 remains in its reset condition for the beginning of a door-open cycle at the teller terminal.

The car door limit switches 114, 116 and 117 in the illustrated car 18 take the form of reed switches activated by magnets carried on the car door 26. For example, as best shown in FIGS. 2 and 2*b*, the open limit switch 116 is a reed switch mounted on the car which is activated by a magnet 141 carried at the opposite end of the door and moved into the vicinity of the switch 116 when the door is opened. A magnet 142 at the near end of the door (as viewed in FIG. 2) is sensed by the reed switch 117 at the opposite end of the car when the door is in its other container-open position. The third reed switch 114 is provided at the opposite end of the car (again as viewed in FIG. 2) which senses the magnet 141 when the car door is closed.

Having described the invention, what is claimed is:

1. A transportation system for transporting cargo comprising:

a track;

a car on the track which includes a portion defining a cargo container;

means for driving the car along the track;

a door on the car movable between a container-closed position in which access to the cargo container is restricted and any of a plurality of alternative container-open positions in which access to the cargo container is permitted;

means for sensing the orientation of the car; and means on the car, coupled to the means for sensing the orientation of the car, for selectively moving the door from the container-closed position to one of the container-open positions, said one of the container-open positions being selected in dependence upon the orientation of the car.

2. The transportation system of claim 1 which further comprises a plurality of stations along the track and in which the means for driving the car along the track includes means for stopping the car at each station of the plurality of stations.

3. The transportation system of claim 2 in which the door is movable from the container-closed position in a first direction to a first container-open position and in a second, opposite, direction to a second container-open position.

4. The transportation system of claim 3 in which the orientation of the car in a first station of said plurality of stations is such that the first direction of door movement is upward and the second direction of door movement is downward and in which the orientation of the car in the second station of said plurality of stations is such that the second direction of movement of the door is upward and the first direction of movement of the door is downward, the means for selectively moving the door comprising means for moving the door from the container-closed position, when the car is in one of said first and second stations, to one of said first and second container-open positions by moving the door downward.

5. The transportation system of claim 1, the transporting cargo comprising:

track having at least one power rail coupled to a source of electrical power; said driving means mounted on the car and electrically coupled to the track power rail for driving the car along the track; said cargo;

door moving means including a drive motor mounted on the car, mechanically coupled to the door and electrically couplable to a source of electrical power to move the door;

the transporation system further comprising control circuit means on the car for selectively coupling electrical power to the door drive motor to move the door.

6. The transportation system of claim 5 which further comprises means along the track for producing a car door movement control signal detectable by said control circuit means on the car and in which the control circuit means is responsive to said control signal to couple electrical power to the door drive motor to move the door.

7. The transportation system of claim 6 in which the door drive motor is electrically couplable to the track power rail.

8. A transportation system for transporting cargo between terminals by a car movable on a track between the terminals, comprising:

a generally U-shaped track having a first end and a second end;

a car movable along the track and having a portion defining a cargo container;

first driving means on the car for moving the car along the track;

an inner door on the car and movable (i) in a first direction between a container-closed position in which access to the cargo container is restricted and a first container-open position in which access to the cargo container is permitted, and (ii) in a second direction between the container-closed position and a second container-open position in which access to the cargo container is permitted;

a customer terminal and a teller terminal each defining a respective interior cavity into which the first track end and the second track end is received, respectively, to interconnect the terminals, the car being receivable in a respective said terminal when the car is moved along the track to a respective said end thereof, the car being in a first orientation in the customer terminal and in a second orientation in the teller terminal;

sensing means for sensing that the car is in a said terminal and the orientation of the car; and second driving means on the car, coupled to the sensing means, for selectively moving the door from the container-closed position to one of the container-open positions, said one of the container-open positions being selected in dependence upon the orientation of the car.

9. The transportation system of claim 8, each said terminal including an outer door movable between a closed position in which access to the terminal interior cavity is restricted and an open position in which access to the terminal interior cavity is permitted, each said outer door positioned on its said terminal so that when the car is received in the terminal and the outer door and inner door are in the closed positions thereof, the inner door is positioned behind and substantially parallel to the outer door.

10. The transportation system of claim 9 which includes third and fourth driving means in the customer terminal and the teller terminal, respectively, each of the third and fourth driving means responsive to the sensing means for moving a respective said outer door from the closed position to the open position when the car is received in an associated said terminal.

11. The transportation system of claim 8 in which the orientation of the car in the customer terminal is such that the first direction of door movement is upward and the second direction of door movement is downward and in which the orientation of the car in the teller terminal is such that the second direction of movement of the door is upward and the first direction of movement of the door is downward, the second driving means comprising means for moving the door from the container-closed position, when the car is in a said terminal, to one of said container-open positions by moving the door downward.

12. The transportation system of claim 11, each said terminal including an outer door movable between a closed position in which access to the terminal interior cavity is restricted and an open position in which access to the terminal interior cavity is permitted, each said outer door positioned on its said terminal so that when the car is received in the terminal and the outer door and inner door are in the closed positions thereof, the inner door is positioned behind and substantially parallel to the outer door.

13. The transporation system of claim 12 which includes third and fourth driving means in the customer terminal and the teller terminal, respectively, each of the third and fourth driving means responsive to the sensing means for moving a respective said outer door from the closed position to the open position when the car is received in an associated said terminal.

14. The transportation system of claim 8 in which the first direction is opposite the second direction.

15. The transportation system of claim 14 in which the orientation of the car in the customer terminal is such that the first direction of door movement is upward and the second direction of door movement is downward and in which the orientation of the car in said teller terminal is such that the second direction of movement of the door is upward and the first direction of movement of the door is downward, the second driving means comprising means for moving the door from the container-closed position, when the car is in a said terminal, to one of said container-open positions by moving the door downward.

16. The transportation system of claim 15, each said terminal including an outer door movable between a closed position in which access to the terminal interior cavity is restricted and an open position in which access to the terminal interior cavity is permitted, each said outer door positioned on its said terminal so that when the car is received in the terminal and the outer door and inner door are in the closed positions thereof, the inner door is positioned behind and substantially parallel to the outer door.

17. The transportation system of claim 16 which includes third and fourth driving means in the customer and teller terminals, respectively, and responsive to the sensing means for moving a respective said outer door from the closed position to the open position when the car is received in an associated said terminal.

18. A transportation system for transporting cargo between a customer terminal and a teller terminal comprising:

a customer terminal having top, front and back walls to define a first interior cavity therebetween;

a teller terminal having top, front and back walls to define a second interior cavity therebetween, the teller terminal spaced from the customer terminal;

a track coupling the customer terminal to the teller terminal, the track having a generally horizontal portion defined between respective ends, a first generally vertical portion extending from within the first interior cavity of the customer terminal to one end of the horizontal portion and a second generally vertical portion extending from within the second interior cavity of the teller terminal to another said end of the horizontal portion, each said vertical portion having a section within a respective said terminal and spaced from said front wall thereof;

each said terminal including an access opening along a said front wall thereof;

a car having back and front walls defining a cargo container therebetween;

a door on the front wall of the car movable in a first direction and an opposite second direction, respectively, from a container-closed position in which access to the cargo container is restricted to a first and a second container-open position, respectively, in which access to the cargo container is permitted;

the car movable on the track by driving means on the car for driving the car along the track and between the terminals;

the terminals adapted to receive the car between a respective said vertical track section and said front wall such that the access opening and the door are in alignment;

the car being in a first orientation in the customer terminal such that the first direction of door movement is upwardly towards said customer terminal top wall and the second direction of door movement is downward, the car being in a second orientation in the teller terminal such that the second direction of movement of the door is upwardly towards said teller terminal top wall and the first direction of movement of the door is downward;

sensing means for sensing when the car is received within a respective terminal and the door is aligned with the opening access of said respective terminal and the orientation of the car;

door control means on the car, coupled to the sensing means, for selectively moving the door in the second direction from the container-closed position to the first container-open position when the car is in the customer terminal and in the first direction from the container-closed position to the second container-open position when the car is in the teller terminal.

19. The transportation system of claim 18 which includes outer doors on each said terminal movable between a closed position in which the access opening is covered and a second position in which the access opening is not covered.

20. The transportation system of claim 19 which includes outer door control means in each terminal responsive to the sensing means for selectively moving the outer door of a respective said terminal from the closed position to the open position when the car is in the respective terminal.

* * * * *

UNITED STATES PATENT AND TRADEMARK OFFICE

CERTIFICATE OF CORRECTION

PATENT NO. : 4,605,102

DATED : August 12, 1986

INVENTOR(S) : Robert E. Morano, Victor J. Vogel and Peter Pawchak

It is certified that error appears in the above-identified patent and that said Letters Patent is hereby corrected as shown below:

In the Abstract - line 1

Change "transportation system" to --transportation system having multiple direction cargo carrier door opener--.

Signed and Sealed this

Fifteenth Day of September, 1987

*Attest:*

DONALD J. QUIGG

*Attesting Officer*

*Commissioner of Patents and Trademarks*